US012286261B2

(12) United States Patent
Suzuki et al.

(10) Patent No.: US 12,286,261 B2
(45) Date of Patent: Apr. 29, 2025

(54) DOUBLE-LAYERED CONTAINER

(71) Applicant: YOSHINO KOGYOSHO CO., LTD., Tokyo (JP)

(72) Inventors: Takanori Suzuki, Tokyo (JP); Seiichi Asaoka, Matsudo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 9 days.

(21) Appl. No.: 18/018,117

(22) PCT Filed: Jul. 28, 2021

(86) PCT No.: PCT/JP2021/027875
§ 371 (c)(1),
(2) Date: Jan. 26, 2023

(87) PCT Pub. No.: WO2022/025107
PCT Pub. Date: Feb. 3, 2022

(65) Prior Publication Data

US 2023/0271741 A1 Aug. 31, 2023

(30) Foreign Application Priority Data

Jul. 31, 2020 (JP) ..... 2020-130568

(51) Int. Cl.
*B65D 1/02* (2006.01)
*B65D 79/00* (2006.01)

(52) U.S. Cl.
CPC ..... *B65D 1/0215* (2013.01); *B65D 1/0276* (2013.01); *B65D 79/0081* (2020.05); *B65D 2205/02* (2013.01)

(58) Field of Classification Search
CPC ..... B65D 1/0215; B65D 79/0081; B65D 1/0276; B65D 2205/02
(Continued)

(56) References Cited

U.S. PATENT DOCUMENTS

2003/0196926 A1* 10/2003 Tobias ..... B65D 1/0284 206/509
2004/0211746 A1* 10/2004 Trude ..... B65D 79/0081 206/508

(Continued)

FOREIGN PATENT DOCUMENTS

JP 2003-276719 A 10/2003
JP 2017-171317 A 9/2017

(Continued)

OTHER PUBLICATIONS

Sep. 7, 2021 Search Report issued in International Patent Application No. PCT/JP2021/027875.

*Primary Examiner* — J. Gregory Pickett
*Assistant Examiner* — Niki M Eloshway
(74) *Attorney, Agent, or Firm* — Oliff PLC

(57) ABSTRACT

A double-layered container including an inner and outer container. A mouth, body and bottom portion respectively extend from top to bottom along a bottle axis. An outside air introduction hole is provided. A diameter of an intermediate portion between an upper and lower end of the body portion is smaller than a diameter of the lower end portion. The intermediate and lower end portions are connected via a step portion. A bottom wall portion includes a ground contact portion and depressed portion. A distance of the outer container inner surface from a connection portion to an outer peripheral edge portion of the ground contact portion in a vertical cross-sectional view along the bottle axis is 1.15 times or less a distance along the outer container inner surface and the bottle axis to an inner peripheral edge portion of the ground contact portion in the vertical cross-sectional view.

5 Claims, 2 Drawing Sheets

(58) Field of Classification Search
USPC ..... 215/12.1
See application file for complete search history.

(56) References Cited

U.S. PATENT DOCUMENTS

| | | | | |
|---|---|---|---|---|
| 2010/0176136 | A1* | 7/2010 | Lacoste | A61J 1/00 220/660 |
| 2016/0176604 | A1* | 6/2016 | Matsuo | B65D 1/0276 215/373 |
| 2017/0283152 | A1* | 10/2017 | Wada | B65D 1/0261 |
| 2017/0297759 | A1* | 10/2017 | Bates | B65D 79/0081 |
| 2019/0100345 | A1* | 4/2019 | Yamaguchi | B29C 49/0005 |
| 2020/0324931 | A1* | 10/2020 | Hosokoshiyama | B65D 83/0055 |
| 2021/0039822 | A1* | 2/2021 | Hosokoshiyama | B29C 49/06 |
| 2021/0269193 | A1* | 9/2021 | Nakayama | B32B 27/365 |
| 2022/0097893 | A1* | 3/2022 | Sasaki | B65D 1/0215 |
| 2022/0332458 | A1* | 10/2022 | Suzuki | B65D 1/46 |

FOREIGN PATENT DOCUMENTS

| | | | | |
|---|---|---|---|---|
| JP | 2019-119478 | A | 7/2019 | |
| JP | 2020-040689 | A | 3/2020 | |
| WO | WO-2020158127 | A1 * | 8/2020 | B65D 1/0215 |

* cited by examiner

DOUBLE-LAYERED CONTAINER

TECHNICAL FIELD

The present invention relates to a double-layered container. Priority is claimed on Japanese Patent Application No. 2020-130568, filed Jul. 31, 2020, the content of which is incorporated herein by reference.

BACKGROUND ART

A double-layered container 100 as shown, for example, in FIG. 2 is known from related art. The double-layered container 100 includes an inner container 112 that decreases in volume and deforms with a decrease in contents that are contained, and an outer container 111 in which the inner container 112 is installed. A mouth portion 113, a body portion 116, and a bottom portion 114 are disposed in this order from top to bottom in a direction of a bottle axis O, and the double-layered container 100 includes an outside air introduction hole 117 that introduces outside air between the outer container 111 and the inner container 112 with the decrease in contents.

In general, the inner container 112 is designed to shrink and deform to overlap in a radial direction with the decrease in contents that are contained, as indicated by a two-dot chain line in FIG. 2. As a double-layered container of this type, a configuration as shown in Patent Document 1 below, for example, is known. In this configuration, an intermediate portion 116*c* located between an upper end portion 116*a* and a lower end portion 116*b* of the body portion 116 has a diameter smaller than a diameter of the lower end portion 116*b*, and the intermediate portion 116*c* and the lower end portion 116*b* are connected via a step portion 116*d* facing the direction of the bottle axis O.

CITATION LIST

Patent Document

[Patent Document 1]
Japanese Unexamined Patent Application, First Publication No. 2017-171317

SUMMARY OF INVENTION

Technical Problem

However, in the double-layered container of the related art, a connection portion 125 between the step portion 116*d* and the lower end portion 116*b* of the body portion 116 is a corner portion. As a result, when the inner container 112 decreases in volume and deforms due to the decrease in contents that are contained, in the inner container 112, a corner portion 112*a* that constitutes the connection portion 125 of the double-layered container 100, and a lower portion 112*b* located below the corner portion 112*a* are displaced around an outer peripheral edge portion 123*a* of a ground contact portion 123 in a direction overlapping the one direction. However, the corner portion 112*a* of the inner container 112 does not easily expand and deform. Therefore, there is a problem that the lower portion 112*b* of the inner container 112 cannot be sufficiently deformed to overlap in the one direction.

In this case, when the inner container 112 decreases in volume and deforms, a limit space X, which is located inside the lower portion 112*b* and cannot be reduced any more, becomes large, and the remaining amount of the contents increases.

The present invention has been made in view of the circumstances described above, and an object of the present invention is to provide a double-layered container that can reduce the remaining amount of contents that are contained.

Solution to Problem

The present invention adopts the following means to solve the above problems. That is, a first aspect of the present invention is a double-layered container which includes an inner container which decreases in volume and deforms with a decrease in contents contained therein; and an outer container in which the inner container is installed, in which a mouth portion, a body portion, and a bottom portion are disposed in this order from top to bottom in a direction of a bottle axis, and the double-layered container includes an outside air introduction hole which introduces outside air between the outer container and the inner container with the decrease in the contents. A diameter of an intermediate portion located between an upper end portion and a lower end portion of the body portion is smaller than a diameter of the lower end portion, and the intermediate portion and the lower end portion are connected via a step portion facing the direction of the bottle axis. The bottom wall portion of the bottom portion includes a ground contact portion located at an outer peripheral edge portion, and a depressed portion having a cylindrical shape with a top, the depressed portion which is located on an inner side in a radial direction from the ground contact portion and recessed upward. A distance along an inner surface of the outer container from a connection portion between the step portion and the lower end portion to an outer peripheral edge portion of the ground contact portion in a vertical cross-sectional view along the direction of the bottle axis is 1.15 times or less a distance along the inner surface of the outer container from an intersection portion between the depressed portion and the bottle axis to an inner peripheral edge portion of the ground contact portion in the vertical cross-sectional view.

In the double-layered container of the first aspect of the present invention, the distance along the inner surface of the outer container from the connection portion between the step portion and the lower end portion of the body portion to the outer peripheral edge portion of the ground contact portion in the vertical cross-sectional view along the direction of bottle axis is 1.15 times or less the distance along the inner surface of the outer container from the intersection portion between the depressed portion and the bottle axis to the inner peripheral edge portion of the ground contact portion in the vertical cross-sectional view. This makes it possible to bring the former distance closer to the latter distance.

Therefore, the connection portion between the step portion and the lower end portion of the body portion is a corner portion. As a result, when the inner container decreases in volume and deforms, in the inner container, the corner portions forming the connection portion do not easily expand and deform. Even if the lower portion located below the corner portion is not sufficiently deformed to overlap in one of the radial directions, due to the decrease in volume and deformation of the inner container, when the corner portion and the lower portion of the inner container are displaced around the ground contact portion in the direction overlapping the one direction, the corner portion and the lower portion of the inner container can be brought closer to the inner surface of the depressed portion, while forming a shape along the inner surface of the depressed portion. As a result, when the inner container decreases in volume and deforms, it is possible to reduce a limit space, which is located inside the lower portion and cannot be reduced any more, thereby reducing the remaining amount of the contents.

According to a second aspect of the present invention, in the double-layered container of the first aspect, the distance in the direction of the bottle axis between the ground contact portion and the connection portion may be twice or less the distance in the direction of the bottle axis between the ground contact portion and the intersection portion.

In this case, the distance in the direction of the bottle axis between the ground contact portion and the connection portion is twice or less the distance between the ground contact portion and the intersection portion in the direction of the bottle axis. As a result, when the corner portion and the lower portion of the inner container are displaced around the ground contact portion in the direction overlapping the one direction due to the decrease in volume and deformation of the inner container, the corner portion and the lower portion of the inner container can be reliably brought closer to the inner surface of depressed portion, while forming a shape along the inner surface of the depressed portion.

According to a third aspect of the present invention, in the double-layered container of the first aspect or the second aspect, the distance in the direction of the bottle axis between the ground contact portion and the connection portion may be half or less the outer diameter of the lower end portion.

In this case, the distance in the direction of the bottle axis between the ground contact portion and the connection portion is half or less the outer diameter of the lower end portion of the body portion. As a result, when the corner portion and the lower portion of the inner container are displaced around the ground contact portion in the direction overlapping the one direction due to the decrease in volume and deformation of the inner container, the corner portion and the lower portion of the inner container can be reliably brought closer to the inner surface of depressed portion, while forming a shape along the inner surface of the depressed portion.

According to a fourth aspect of the present invention, in the double-layered container of any one of the first aspect to the third aspect, upper and lower surfaces of a ceiling wall portion of the depressed portion may be flat surfaces.

In this case, the upper and lower surfaces of the ceiling wall portion of the depressed portion are flat surfaces. As a result, the limit space of the inner container can be reliably minimized.

Advantageous Effects of Invention

According to the present invention, it is possible to reduce the remaining amount of contained contents.

DESCRIPTION OF EMBODIMENTS

A double-layered container according to an embodiment of the present invention will be described below with reference to the drawings.

Figure 1:
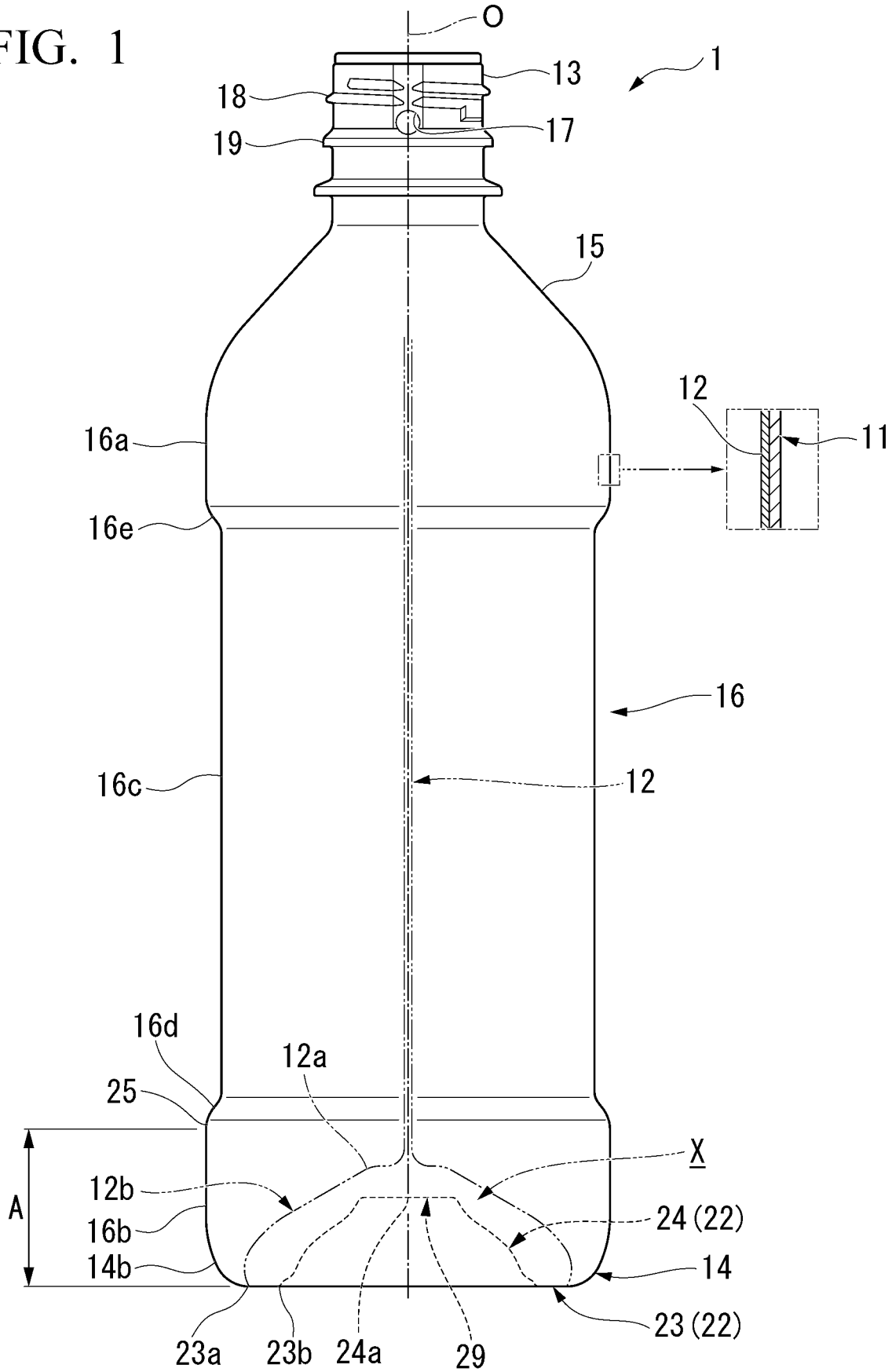
FIG. 1 is a side view including a partial vertical cross-sectional view of a double-layered container shown as an embodiment of the present invention from the outside in a radial direction.
Figure 2:
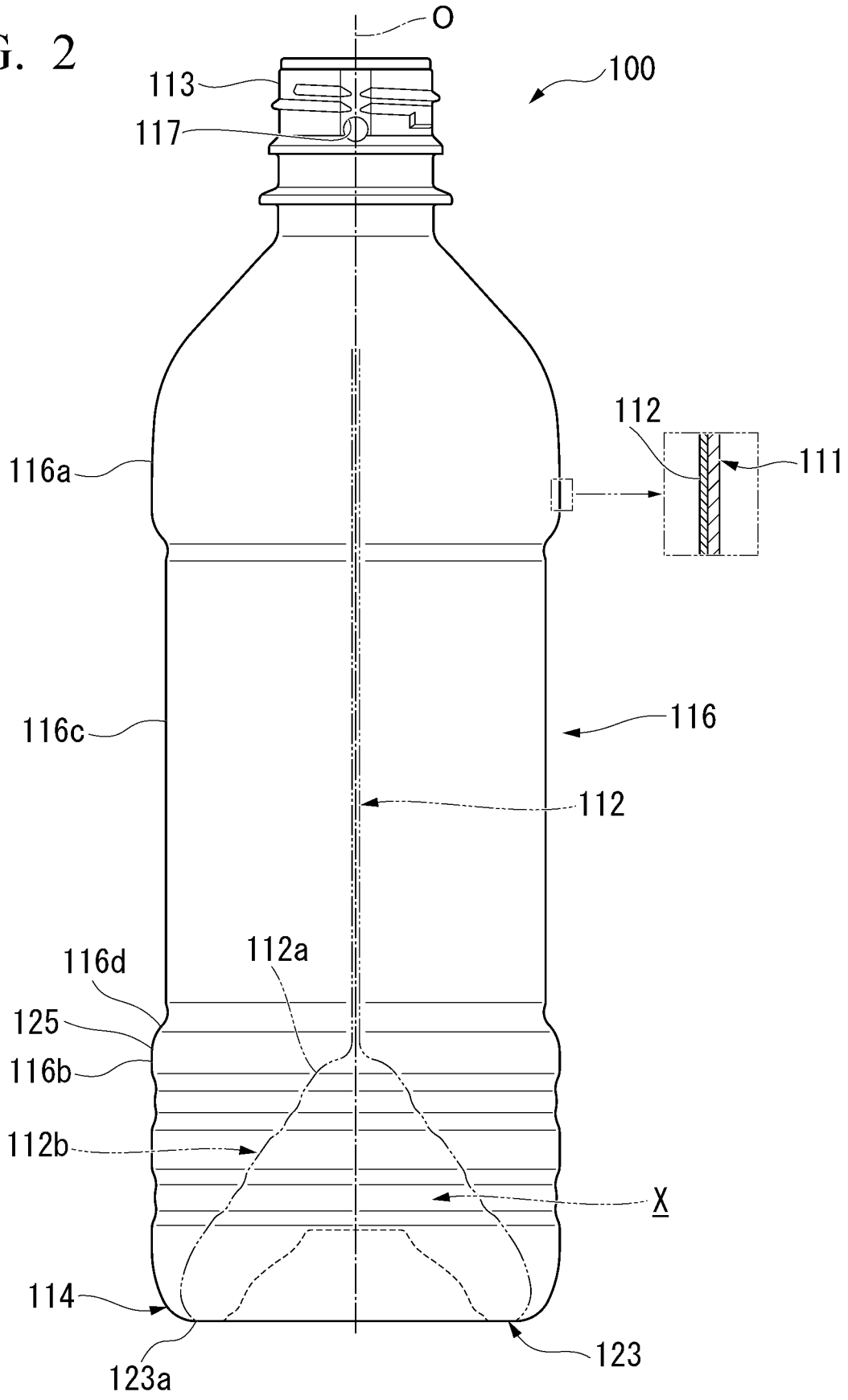
FIG. 2 is a side view including a partial vertical cross-sectional view of a double-layered container shown as a conventional example according to the present invention from the outside in the radial direction.

As shown in FIG. 1, a double-layered container 1 according to the present embodiment includes an inner container 12 that decreases in volume and deforms due to a decrease in contained contents, and an outer container 11 in which the inner container 12 is installed. The outer surface of the inner container 12 is provided on the inner surface of the outer container 11 in a separable manner. In the shown example, the inner container 12 is highly flexible and is laminated on the inner surface of the outer container 11 in a peelable manner.

A gap may be provided between the inner surface of the outer container 11 and the outer surface of the inner container 12.

The double-layered container 1 is formed by integrally blow-molding an outer preform and an inner preform in a state in which the inner preform for forming the inner container 12 is fitted into the outer preform for forming the outer container 11. That is, the double-layered container 1 is a biaxially stretched blow container.

The material of the inner container 12 and the outer container 11 is a synthetic resin material, and both may be made of the same material or different materials. Examples of the synthetic resin material include polyethylene terephthalate (i.e., PET), polypropylene (i.e., PP), polyethylene (i.e., PE), nylon (i.e., polyamide), and ethylene-vinyl alcohol copolymer (i.e., EVOH).

The double-layered container 1 has a mouth portion 13, a shoulder portion 15, a body portion 16 and a bottom portion 14. The mouth portion 13, the shoulder portion 15, the body portion 16 and the bottom portion 14 are disposed coaxially with a common axis in this order.

Hereinafter, this common axis will be referred to as a bottle axis O, the mouth portion 13 side of the double-layered container 1 along the bottle axis O will be referred to as an upper side, and the bottom portion 14 side of the double-layered container 1 will be referred to as a lower side. When viewed from the direction of the bottle axis O, a direction intersecting the bottle axis O is referred to as a radial direction, and a direction around the bottle axis O is referred to as a circumferential direction.

The mouth portion 13 of the double-layered container 1 is formed by laminating the mouth portion of the inner container 12 and the mouth portion of the outer container 11. The shoulder portion 15 of the double-layered container 1 is formed by laminating the shoulder portion of the inner container 12 and the shoulder portion of the outer container 11. The body portion 16 of the double-layered container 1 is formed by laminating the body portion of the inner container 12 and the body portion of the outer container 11. The bottom portion 14 of the double-layered container 1 is formed by laminating the bottom portion of the inner container 12 and the bottom portion of the outer container 11.

In the following description, unless otherwise specified, both the inner container 12 and the outer container 11 have the same shape.

The size of the double-layered container 1 in the direction of the bottle axis O is, for example, 115 mm or more and 220 mm or less. The internal volume of the double-layered container 1 is, for example, 150 ml or more and 600 ml or less. In the shown example, the size of the double-layered container 1 in the direction of the bottle axis O is about 208 mm, and the inner capacity of the double-layered container 1 is 450 ml.

The mouth portion 13 of the double-layered container 1 is formed in a cylindrical shape extending upward from the upper end portion of the shoulder portion 15.

A flange portion which protrudes outward in the radial direction and extends continuously over the entire length in the circumferential direction is formed at the upper end portion of the mouth portion of the inner container 12. The flange portion is placed on an upper opening edge of the mouth portion of the outer container 11.

A male threaded portion 18 to which a cap (that is not shown) is screwed and a sealed protrusion 19 to which a peripheral wall portion of the cap (that is not shown) is externally fitted are formed in this order on the outer peripheral surface of the mouth portion of the outer container 11 from top to bottom. The sealed protrusion 19 protrudes outward in the radial direction from the mouth portion of the outer container 11 and extends continuously over the entire length in the circumferential direction. A space (i.e., gap) between the outer peripheral surface of the sealed protrusion 19 and the inner peripheral surface of the peripheral wall portion of the cap (that is not shown) is air-tightly sealed.

The cap may be undercut-fitted to the mouth portion of the outer container 11.

An outside air introduction hole 17 that introduces outside air into the space between the outer container 11 and the inner container 12 with the decrease in the contents is formed in the mouth portion of the outer container 11. The outside air introduction hole 17 is positioned on the outermost side in the radial direction in the sealed protrusion 19, and is positioned above the sealing surface that extends continuously over the entire length in the circumferential direction.

A formation position of the outside air introduction hole 17 is not limited to the mount portion of the outer container 11. The formation position of the outside air introduction hole 17 may be, for example, the body portion, the shoulder portion, or the bottom portion of the outer container 11 other than the mouth portion, and may be between the upper opening edge of the mouth portion of the outer container 11 and the lower surface of the flange portion of the mouth portion of the inner container 12, or the like.

The shoulder portion 15 extends outward in the radial direction downward from the lower end portion of the mouth portion 13.

The bottom portion 14 is formed in a cylindrical shape with a bottom. The outer peripheral surface of the peripheral wall portion 14*b* of the bottom portion 14 extends inward in the radial direction from top to bottom.

A diameter of an intermediate portion 16*c* located between the upper end portion 16*a* and the lower end portion 16*b* of the body portion 16 is smaller than the diameter of the lower end portion 16*b*, and the intermediate portion 16*c* and the lower end portion 16*b* are connected via a lower step portion (i.e., step portion) 16*d* that faces the direction of the bottle axis O.

The upper end portion 16*a*, the lower end portion 16*b*, and the intermediate portion 16*c* of the body portion 16 extend straight in the direction of the bottle axis O. The outer peripheral surface of the lower end portion 16*b* of the body portion 16 is a maximum outer diameter portion having the largest outer diameter in the double-layered container 1. An outer diameter of the lower end portion 16*b* of the body portion 16 is, for example, 58 mm or more and 74 mm or less. In the shown example, the outer diameter of the lower end portion 16*b* of the body portion 16 is approximately 67 mm.

The size of the intermediate portion 16*c* of the body portion 16 in the direction of the bottle axis O is equal to or more than half the size of the body portion 16 in the direction of the bottle axis O. The size of the intermediate portion 16*c* of the body portion 16 in the direction of the bottle axis O is larger than the sizes of each of the mouth portion 13, the shoulder portion 15, and the bottom portion 14 in the direction of the bottle axis O. The outer diameter of the intermediate portion 16*c* of the body portion 16 is, for example, 90% or more and 95% or less the outer diameter of the lower end portion 16*b* of the body portion 16.

A lower step portion 16*d* of the body portion 16 extends downward as it goes outward in the radial direction. In the shown example, in the body portion 16, the diameter of the intermediate portion 16*c* is smaller than the diameter of the upper end portion 16*a*, and the intermediate portion 16*c* and the upper end portion 16*a* are connected via an upper step portion 16*e* that faces the direction of the bottle axis O. The upper step portion 16*e* extends upward toward the outside in the radial direction. The upper end portion 16*a* and the lower end portion 16*b* of the body portion 16 have the same diameter. The sizes of each of the lower step portion 16*d* and the upper step portion 16*e* in the direction of the bottle axis O are equal to each other.

The sizes of each of the lower step portion 16*d* and the upper step portion 16*e* in the direction of the bottle axis O may be different from each other. The lower step portion 16*d* and the upper step portion 16*e* may extend straight in the radial direction. The upper end portion 16*a* and the intermediate portion 16*c* of the body portion 16 may have the same diameter, and the upper step portion 16*e* may not be provided.

Further, the intermediate portion 16*c* of the body portion 16 may be a constricted portion that extends inward in the radial direction from the outside toward the inside along the direction of the bottle axis O. In this case, when the intermediate portion 16*c* of the body portion 16 is pressed inward in the radial direction, the intermediate portion 16*c* can be smoothly elastically deformed inward in the radial direction with a light pressing force.

At least the body portion of the outer container 11 is capable of being squeeze-deformed (that is, elastically deformed), and the inner container 12 shrinks and deforms with squeeze-deformation of the outer container 11. The body portion 16, the shoulder portion 15 and the bottom portion 14 are continuous in the direction of the bottle axis O without a step. The outer container 11 may be formed in a non-elastically deformable manner.

An adhesive layer that bonds the outer surface of the inner container 12 to the inner surface of the outer container 11 may be provided between the inner surface of the outer container 11 and the outer surface of the inner container 12.

In this case, the adhesive layer may be formed in a belt shape extending in the direction of the bottle axis O. In addition, the adhesive layer may be separately provided at positions opposite to each other in the other direction perpendicular to one direction in the radial direction, between the inner surface of the outer container 11 and the outer surface of the inner container 12 so that the inner container 12 shrinks in one radial direction and overlaps with the reduction in the contents to be contained therein.

Here, a bottom wall portion 22 of the bottom portion 14 includes a ground contact portion 23 positioned at the outer peripheral edge portion, and a depressed portion 24 having a cylindrical shape with a top positioned on the inner side in the radial direction than the ground contact portion 23 and recessed upward. The ground contact portion 23 and the depressed portion 24 are disposed coaxially with the bottle axis O. The ground contact portion 23 and the depressed portion 24 are provided to be connected to each other in the radial direction.

Upper and lower surfaces of a ceiling wall portion 29 of the depressed portion 24 are flat surfaces. The ground contact portion 23 is formed in a strip shape having a width in the radial direction and extending in the circumferential direction. The ground contact portion 23 does not have a width in the radial direction, and may be formed in a linear shape extending in the circumferential direction.

The distance along the inner surface of the outer container 11 from the connection portion 25 between the lower step portion 16*d* and the lower end portion 16*b* of the body portion 16 to the outer peripheral edge portion 23*a* of the ground contact portion 23 in a vertical cross-sectional view along the direction of the bottle axis O and the one direction is 1.15 times or less, preferably 1.0 times or more and 1.15 times or less the distance along the inner surface of the outer container 11 from the intersection portion 24*a* between the depressed portion 24 and the bottle axis O to the inner peripheral edge portion 23*b* of the ground contact portion 23 in the vertical cross-sectional view.

In the shown example, the intersection portion 24*a* is a central portion in the radial direction of the ceiling wall portion 29 of the depressed portion 24.

A distance A between the ground contact portion 23 and the connection portion in the direction of the bottle axis O is twice or less, preferably 1.2 times or more and 2 times or less the distance between the ground contact portion 23 and the intersection portion 24*a* in the direction of the bottle axis O. The distance A between the ground contact portion 23 and the connection portion 25 in the direction of the bottle axis O is half or less, preferably 0.3 times or more and 0.5 times or less the outer diameter of the lower end portion 16*b* of the body portion 16.

As described above, according to the double-layered container 1 according to the present embodiment, the distance along the inner surface of the outer container 11 from the connection portion 25 between the lower step portion 16*d* and the lower end portion 16*b* of the body portion 16 to the outer peripheral edge portion 23*a* of the ground contact portion 23 in the vertical cross-sectional view is 1.15 times or less the distance along the inner surface of the outer container 11 from the intersection portion 24*a* between the depressed portion 24 and the bottle axis O to the inner peripheral edge portion 23*b* of the ground contact portion 23 in the vertical cross-sectional view. This makes it possible to bring the former distance closer to the latter distance.

Therefore, the connection portion 25 of the body portion 16 is a corner portion. As a result, when the inner container 12 decreases in volume and deforms, in the inner container 12, the corner portions 12*a* forming the connection portion 25 of the double-layered container 1 are hard to expand and deform. At the same time, even if the lower portion 12*b* located below the corner portion 12*a* is not sufficiently deformed to overlap in one of the radial directions, due to the decrease in volume and deformation of the inner container 12, as shown by the two-dot chain line in FIG. 1, when the corner portion 12*a* and the lower portion 12*b* of the inner container 12 are displaced around the ground contact portion 23 in the direction of overlapping in the one direction, the corner portion 12*a* and the lower portion 12*b* of the inner container 12 can be brought closer to the inner surface of the depressed portion 24, while forming a shape along the inner surface of the depressed portion 24.

As a result, when the inner container 12 decreases in volume and deforms, it is possible to reduce the limit space X, which is located inside the lower portion 12*b* and cannot be reduced any more, thereby reducing the remaining amount of the contents.

At this time, in the shown example, the size of the limit space X in the direction of the bottle axis O is the same over the entire area.

Further, the distance A between the ground contact portion 23 and the connection portion 25 in the direction of the bottle axis O is twice or less the distance between the ground contact portion 23 and the intersection portion 24*a* in the direction of the bottle axis O. As a result, when the corner portion 12*a* and the lower portion 12*b* of the inner container 12 are displaced around the ground contact portion 23 in the direction of overlapping in the one direction due to the decrease in volume and deformation of the inner container 12, the corner portion 12*a* and the lower portion 12*b* of the inner container 12 can be reliably brought closer to the inner surface of depressed portion 24, while forming a shape along the inner surface of the depressed portion 24.

In addition, the distance A between the ground contact portion 23 and the connection portion 25 in the direction of the bottle axis O is half or less the outer diameter of the lower end portion 16*b* of the body portion 16. As a result, when the corner portion 12*a* and the lower portion 12*b* of the inner container 12 are displaced around the ground contact portion 23 in the direction of overlapping in the one direction due to the decrease in volume and deformation of the inner container 12, the corner portion 12*a* and the lower portion 12*b* of the inner container 12 can be reliably brought closer to the inner surface of depressed portion 24, while forming a shape along the inner surface of the depressed portion 24.

Further, the upper and lower surfaces of the ceiling wall portion 29 of the depressed portion 24 are flat surfaces. As a result, the limit space X of the inner container 12 can be reliably suppressed small.

The technical scope of the present invention is not limited to the above-described embodiments, and various modifications can be made without departing from the scope of the present invention.

For example, the cross-sectional shape of the body portion 16 is not limited to a circular shape, and may be an elliptical shape, a rectangular shape, or the like.

In addition, within the scope of the present invention, it is possible to appropriately replace the components in the embodiment with known components, and the above embodiments and modifications may be combined as appropriate.

INDUSTRIAL APPLICABILITY

According to the present invention, it is possible to reduce the remaining amount of contents to be contained.

REFERENCE SIGNS LIST

1 Double-layered container
11 Outer container
12 Inner container
13 Mouth portion
14 Bottom portion
16 Body portion
16*a* Upper end portion

16*b* Lower end portion
16*c* Intermediate portion
16*d* Lower end portion (i.e., step portion)
17 Outside air introduction hole
22 Bottom wall portion
23 Ground contact portion
23*a* Outer peripheral edge portion
23*b* Inner peripheral edge portion
24 Depressed portion
24*a* Intersection portion
25 Connection portion
29 Ceiling wall portion
O Bottle axis

What is claimed is:

1. A double-layered container comprising:

an inner container which decreases in volume and deforms with a decrease in contents contained therein; and an outer container in which the inner container is installed, wherein a mouth portion, a body portion, and a bottom portion are disposed in this order from top to bottom in a direction of a bottle axis, the double-layered container includes an outside air introduction hole which introduces outside air between the outer container and the inner container with the decrease in the contents, wherein a diameter of an intermediate portion located between an upper end portion and a lower end portion of the body portion is smaller than a diameter of the lower end portion, the intermediate portion and the lower end portion are connected via a step portion facing the direction of the bottle axis, the bottom wall portion of the bottom portion includes a ground contact portion located at an outer peripheral edge portion, and a depressed portion having a cylindrical shape with a top, the depressed portion which is located on an inner side in a radial direction from the ground contact portion and recessed upward, a distance along an inner surface of the outer container from a connection portion between the step portion and the lower end portion to an outer peripheral edge portion of the ground contact portion in a vertical cross-sectional view along the direction of the bottle axis is 1.15 times or less a distance along the inner surface of the outer container from an intersection portion between the depressed portion and the bottle axis to an inner peripheral edge portion of the ground contact portion in the vertical cross-sectional view, the inner container includes:

a corner portion forming the connection portion, and a lower portion forming the lower end portion, the step portion extends over an entire circumference in a circumferential direction when viewed from the direction of the bottle axis, and the corner portion and the lower portion of the inner container are configured to, due to a decrease in volume and deformation of the inner container, be displaced around the ground contact portion inward in the radial direction, be brought closer to an inner surface of the depressed portion, and form a shape along the inner surface of the depressed portion in the vertical cross-sectional view.

2. The double-layered container according to claim 1, wherein the distance in the direction of the bottle axis between the ground contact portion and the connection portion is twice or less the distance in the direction of the bottle axis between the ground contact portion and the intersection portion.

3. The double-layered container according to claim 1, wherein the distance in the direction of the bottle axis between the ground contact portion and the connection portion is half or less the outer diameter of the lower end portion.

4. The double-layered container according to claim 1, wherein upper and lower surfaces of a ceiling wall portion of the depressed portion are flat surfaces.

5. The double-layered container according to claim 1, wherein a cross-sectional shape of the body portion is a circular shape.

* * * * *